US007571714B2

(12) United States Patent
Miyashiro

(10) Patent No.: US 7,571,714 B2
(45) Date of Patent: Aug. 11, 2009

(54) RELATIVE CONFIGURATION OF AN ENGINE INTAKE PIPE FOR A MOTORCYCLE

(75) Inventor: Shidehiko Miyashiro, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 12/024,862

(22) Filed: Feb. 1, 2008

(65) Prior Publication Data

US 2008/0184961 A1 Aug. 7, 2008

(30) Foreign Application Priority Data

Feb. 1, 2007 (JP) ..... 2007-022580
Jan. 10, 2008 (JP) ..... 2008-003727

(51) Int. Cl.
*F02M 61/14* (2006.01)
*F02M 37/04* (2006.01)

(52) U.S. Cl. ..... 123/470; 123/509

(58) Field of Classification Search ..... 123/445, 123/514, 516, 519, 541; 285/45
See application file for complete search history.

(56) References Cited

U.S. PATENT DOCUMENTS 3,751,076 A * 8/1973 Thais et al. ..... 285/62
4,425,977 A * 1/1984 Michiuchi ..... 180/225
5,560,446 A * 10/1996 Onishi ..... 180/219
5,850,822 A * 12/1998 Romann et al. ..... 123/549
6,279,541 B1 * 8/2001 Doane et al. ..... 123/497
6,401,750 B2 * 6/2002 Tokunaga ..... 137/565.34
6,780,214 B2 * 8/2004 Leibold ..... 123/198 E
7,073,617 B2 * 7/2006 Miyashiro et al. ..... 180/219
7,086,389 B2 * 8/2006 Yamada ..... 123/516
2004/0244843 A1 * 12/2004 Harigaya et al. ..... 137/574

FOREIGN PATENT DOCUMENTS

JP 1191674 A * 4/1999
JP 2005-529030 9/2005

* cited by examiner

*Primary Examiner*—Stephen K Cronin
*Assistant Examiner*—David Hamaoui
(74) *Attorney, Agent, or Firm*—Hogan & Hartson LLP

(57) ABSTRACT

A vehicle has a body frame that does not interfere with an injector. A down tube extends downward to the rear. An engine is disposed with its cylinder axis inclined rearward. An intake pipe located between the down tube and the engine extends obliquely upward from a forward side of the engine. A fuel injector is attached to the intake pipe. The intake pipe includes a straight throttle body connected to the engine. The fuel injector is mounted on a rearward side of the throttle body relative to a forward side where the down tube is disposed.

18 Claims, 13 Drawing Sheets

RELATIVE CONFIGURATION OF AN ENGINE INTAKE PIPE FOR A MOTORCYCLE

RELATED APPLICATIONS

This application claims the benefit of priority under 35 USC 119 of Japanese patent application no. 2007-022580, filed on Feb. 1, 2007, and Japanese patent application no. 2008-003727, filed on Jan. 10, 2008, which applications are hereby incorporated by reference in their entireties.

BACKGROUND OF THE INVENTION

1. Field of the Invention

The present invention relates to a vehicle having an intake pipe.

2. Description of Related Art

A vehicle having an intake pipe is known. JP-A-2005-529030, for example, discloses a motorcycle having a body frame extending downward to the rear; an engine oriented with its cylinder axis angled rearward; an intake pipe connected to a front side of the engine; and a fuel injector attached to the intake pipe. The body frame passes on the upper side of the intake pipe, and the injector is attached to the upper side of the intake pipe.

Thus, in JP-A-2005-529030, the body frame and injector are both located on the upper side of the intake pipe. This, however, leads to a problem that the body frame and fuel injector tend to interfere with each other.

SUMMARY OF THE INVENTION

The present invention solves the foregoing problem and provides a vehicle in which the body frame and injector do not interfere with each other.

A vehicle according to one aspect of the invention includes a head pipe and an engine disposed with a cylinder axis thereof inclined rearward. A body frame is located in front of the engine and extends downward from the head pipe. An intake pipe is located between the body frame and the engine and extends obliquely upward from a forward side of the engine. A fuel injector is mounted to the intake pipe. The intake pipe has a straight connecting part that is connected to the engine, and the fuel injector is mounted on a rearward side of the intake pipe relative to a forward side where the body frame is disposed.

As described above, the engine is disposed with its cylinder axis inclined rearward such that a center of gravity of the engine is located rearward and is close to a center of gravity of the vehicle that is rearward relative to the center of gravity of the engine. Therefore, the moment of inertia about the center of gravity of the vehicle is reduced and maneuverability of the vehicle is improved. In addition, the intake pipe is provided on the forward side of the engine disposed with its cylinder axis inclined rearward, which creates a space around the intake pipe provided on the forward side of the engine. This readily allows a connecting part of the intake pipe, which is in a straight form, to connect to the engine. Further, the fuel injector is mounted on a rearward side of the intake pipe relative to a forward side where the body frame is disposed, which prevents interference between the fuel injector and the body frame. This eliminates the need for a curved part in the intake pipe designed to prevent interference between the fuel injector and the body frame. Therefore, the connecting part of the intake pipe connected to the engine can be in a straight form to reduce air intake resistance and improve engine performance.

In one embodiment, an air cleaner is located in front of and above the engine. The intake pipe includes a curved part located upstream of the connecting part of the intake pipe, and an upstream part located upstream of the curved part and extending toward the air cleaner. This construction allows the air cleaner to be disposed apart from the engine at a location in front of and above the engine, thereby decreasing the temperature of air flowing through the air cleaner and the intake pipe. The density of air drawn into the engine thereby increases and intake efficiency of the engine is improved. In addition, because the air cleaner is located in front of and above the engine, and thus apart from a rear wheel, mud and so forth splashed by the rear wheel is prevented from entering and contaminating the air cleaner. The size of the air cleaner can thereby be reduced.

In one embodiment, a fuel tank extends rearward from the air cleaner and includes an upper overlying part that lies over an upper part of the air cleaner. A center of gravity of the fuel tank is thus located rearward and is close to the center of gravity of the vehicle, which is rearward of the center of gravity of the fuel tank. The moment of inertia about the center of gravity of the vehicle is thereby further reduced and maneuverability of the vehicle further improved. In addition, since the fuel tank lies over the upper part of the air cleaner, the capacity of the fuel tank increases.

In one embodiment, the fuel tank includes a side overlying part that lies over a side part of the air cleaner. Such a construction further increases the capacity of the fuel tank.

In one embodiment, a seat is located above a rear part of the fuel tank. The fuel tank thus can extend rearward, so that its center of gravity is located rearward, while capacity of the fuel tank further increases.

In one embodiment, an exhaust pipe is connected to a rearward side of the engine. A silencer is connected to the exhaust pipe above and behind the engine. A part of the exhaust pipe connected to the silencer is higher than a part of the exhaust pipe connected to the engine. The exhaust pipe thus connects to the silencer without passing below the engine and does not contact the ground and become damaged, for example, during off-road and mountain travel.

In one embodiment, an axis of connection between the exhaust pipe and the silencer is higher than an axis of connection between the exhaust pipe and the engine. The part of the exhaust pipe connected to the silencer is thus higher than the part of the exhaust pipe connected to the engine.

In one embodiment, the exhaust pipe includes a straight connecting part connected to the engine, and a portion coupled with the connecting part and extending upward to the rear. Exhaust resistance of air discharged from the engine is thereby reduced, which improves engine performance.

In one embodiment, a rear wheel is rotatably mounted to an axle, and the exhaust pipe is higher than the axle. The exhaust pipe is thereby connected to the silencer without passing below the axle. Therefore, damage to the exhaust pipe from contacting the ground is prevented.

In one embodiment, a rear arm supports the rear wheel, and the exhaust pipe is higher than the rear arm. The exhaust pipe is thus connected to the silencer without passing below the rear arm, and therefore is further prevented from contacting the ground and being damaged.

In one embodiment, the engine includes a crankcase, and the exhaust pipe is higher than the crankcase. The exhaust pipe connects to the silencer without passing below the crankcase, and is thereby further prevented from contacting the ground and being damaged.

In one embodiment, a throttle valve is provided within the connecting part to adjust an amount of air flowing through an interior of the intake pipe. The fuel injector includes a first fuel injector mounted upstream of the throttle valve in the connecting part and a second fuel injector mounted downstream of the throttle valve in the connecting part. The first and second fuel injectors are able to spray a larger amount of fuel to air flowing through the intake pipe toward the engine, compared to a case where a single fuel injector is provided. Combustibility of the air-fuel mixture in the engine is thereby improved, and engine output is increased.

In one embodiment, a main frame connected to a rear part of the head pipe passes over the engine in a longitudinal direction. A fuel tank is located above the main frame, and a fuel pump supplies fuel from the fuel tank to the fuel injector. The fuel tank includes a recess formed into a concave shape that extends upward from a bottom of the fuel tank. The fuel pump is accommodated in the recess and thereby protected from physical shock and the like.

In one embodiment, the fuel injector is forward of the fuel pump. Space for placing the fuel injector is thereby facilitated, compared to a case where the fuel injector is placed behind the fuel pump, where many parts are usually laid out.

In one embodiment, a first hose is connected to the fuel pump and a second hose is connected to the fuel injector. The first and second hoses can be connected in an area where relatively fewer peripheral parts are laid out, after placing the fuel pump at a predetermined location. Therefore, the work of connecting the fuel injector and the fuel pump is facilitated, compared to a case where the fuel pump and the fuel injector are assembled, and then a hose is connected directly to the fuel pump and the fuel injector around which many peripheral parts are laid out.

In one embodiment, a hose connecting part connects the first and second hoses, and a protective member is mounted to the main frame to cover the hose connecting part. Sand, dust and the like is thereby prevented from entering the hose connecting part.

In one embodiment, the hose connecting part includes a first hose connecting part connectable to a second hose connecting part. The protective member includes a one-side protective member engageable with an other-side protective member. The one-side protective member can be engaged with the other-side protective member only when the first and second hose connecting parts are connected in a normal state. One can thereby confirm whether the first and second hose connecting parts are connected normally when the protective member is assembled.

The vehicle according to the invention may be an off-road motorcycle. With the construction described above, interference between the body frame and the injector of the off-road motorcycle is prevented.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Figure 1:
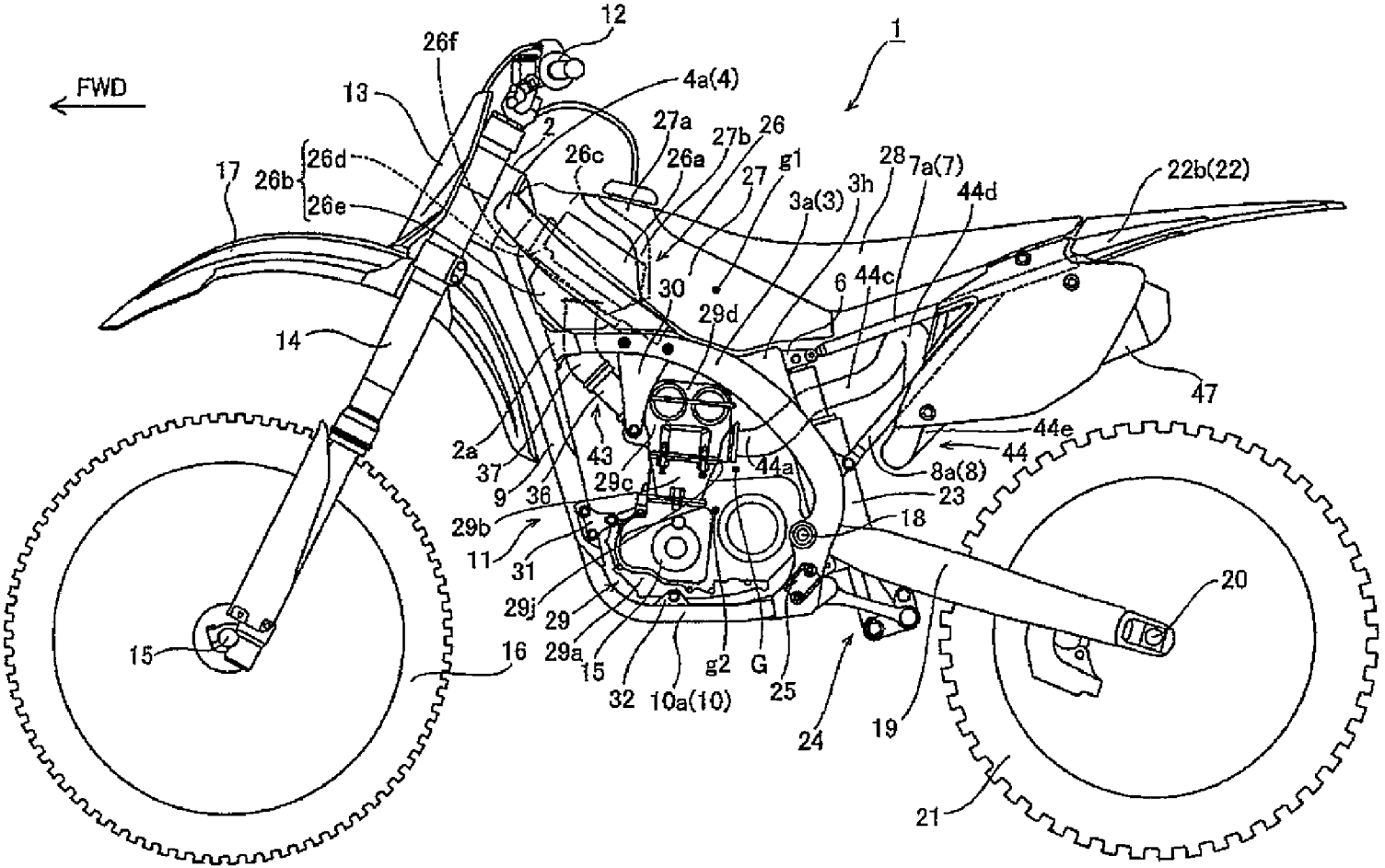
FIG. 1 is a side view of a motorcycle according to a first embodiment of the present invention.

A preferred embodiment of the present invention is now described with reference to the drawings.

First Embodiment

FIGS. 1-12 illustrate a motorcycle 1 according to a first embodiment of the invention. An off-road motorcycle 1 is described as an example of the vehicle of the invention. The direction indicated by arrow FWD in the drawings is a forward traveling direction of motorcycle 1. In the following description, directions such as "left", "right", "forward", "rearward", "up"and "down" are from the perspective of a rider facing forward (in the direction of arrow FWD).

Figure 2:
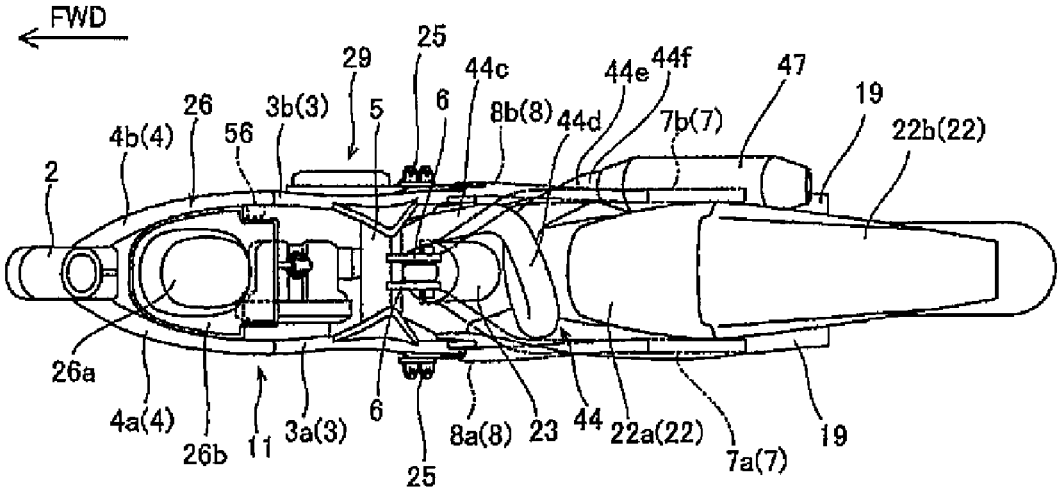
FIG. 2 is a top plan view of the motorcycle of FIG. 1.

Motorcycle 1 includes a body frame 11 comprising a head pipe 2, a main frame 3, a tank rail 4, a seat rail 7, a backstay 8, a down tube 9 and a bottom frame 10. As shown in FIG. 1, left and right frames 3*a* and 3*b* (FIG. 2) of main frame 3 are connected to a connecting part 2*a* or a rear part of a head pipe 2. Frames 3*a* and 3*b* extend downward to the rear and pass over engine 29 in a longitudinal direction. Left and right tank rails 4*a* and 4*b* of tank rail 4 are located between a rear part of head pipe 2 and a top part of frames 3*a* and 3*b*. As shown in FIG. 2, top rear parts of left and right frames 3*a* and 3*b* are coupled by a connecting member 5. Left and right rails 7*a* and 7*b* of seat rail 7 extend upward and rearward and are connected to connecting member 5 through a support 6 formed integral with connecting member 5. Left and right stays 8*a* and 8*b* of backstay 8 are connected, respectively, between frames 3*a* and 3*b* and seat rails 7*a* and 7*b*. Down tube 9, which is an example of a "body frame" of the present invention, extends downward and rearward on the bottom side of head pipe 2. Left (10*a*) and right bottom frames of bottom frame 10 located at a bottom end of down tube 9 connect down tube 9 and frames 3*a* and 3*b*.

Handlebars 12 are pivotally disposed on the top of head pipe 2. A front number plate 13 covers a front part of head pipe 2. A pair of front forks 14 are located below head pipe 2. An axle 15 is fixed to bottom ends of front forks 14. A front wheel 16 is rotatably mounted to axle 15. A front fender 17 covers an upper part of front wheel 16.

Figure 3:
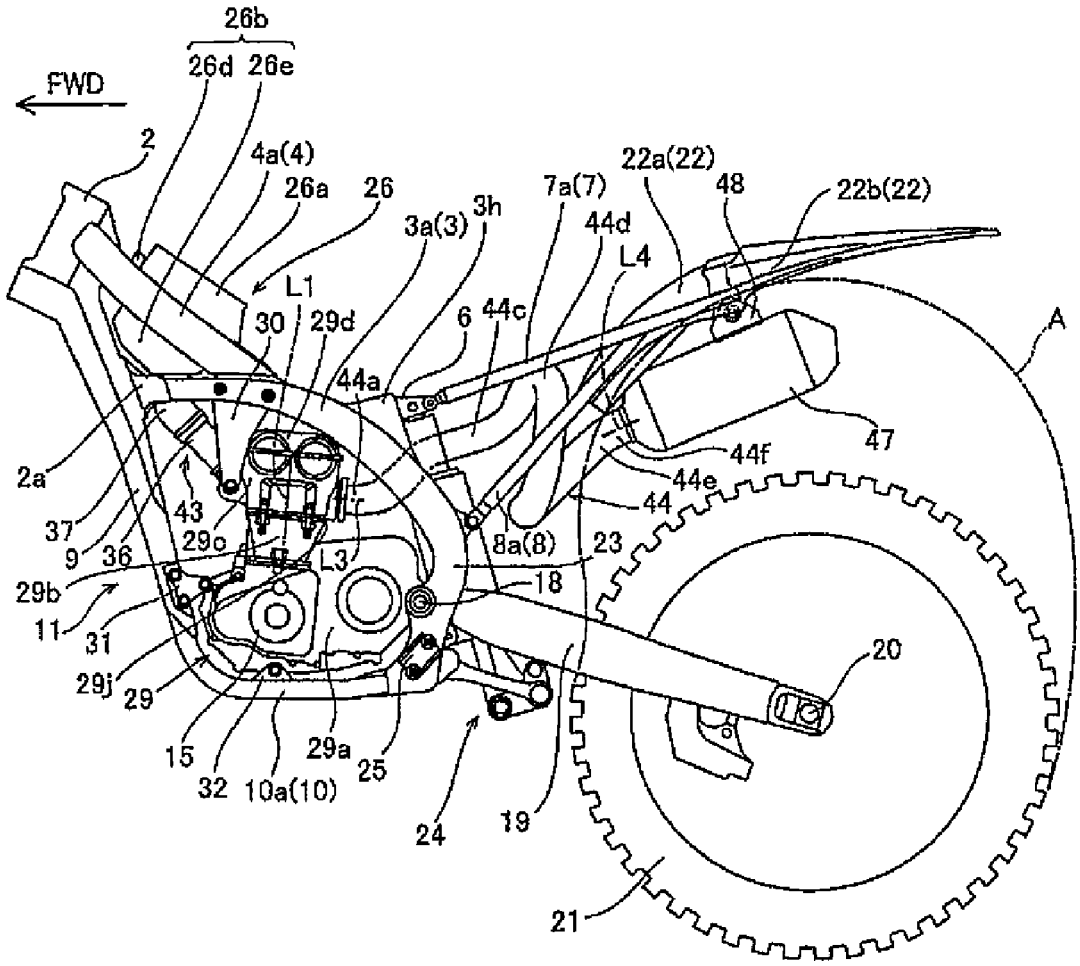
FIG. 3 is a side view of a portion of the motorcycle of FIG. 1.

A pivot shaft 18 provided through main frame 3 supports a rear arm 19 for vertical pivotal movement. A rear wheel 21 is rotatably mounted to axle 20 fixed to a rear end of rear arm 19. A rear fender 22 covers an upper part of rear wheel 21. As shown in FIG. 3, rear fender 22 comprises a front fender 22*a* and a rear fender 22*b*.

A rear suspension 23 disposed at the rear of main frame 3 absorbs shock caused by vertical pivotal movement of rear arm 19. An upper part of rear suspension 23 is supported by main frame 3 through support 6 (see FIG. 2) of connecting member 6, and a lower part of rear suspension 23 is coupled with rear arm 19 through a coupling member 24. Footrest holding plates 25 are fixed to frames 3*a* and 3*b*.

Figure 4:
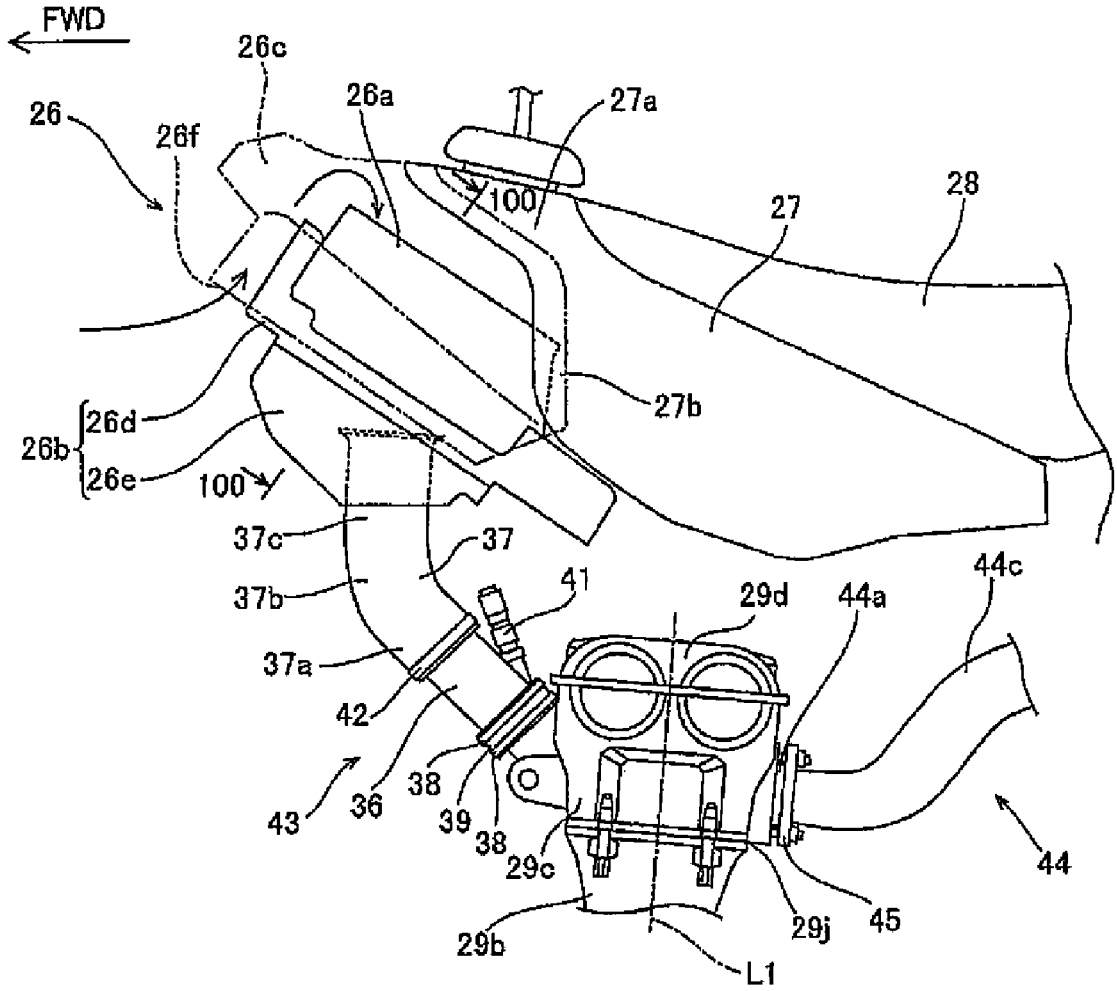
FIG. 4 is a side view of a portion of the motorcycle of FIG. 1 including an engine, an intake pipe, an air cleaner and surroundings.
Figure 5:
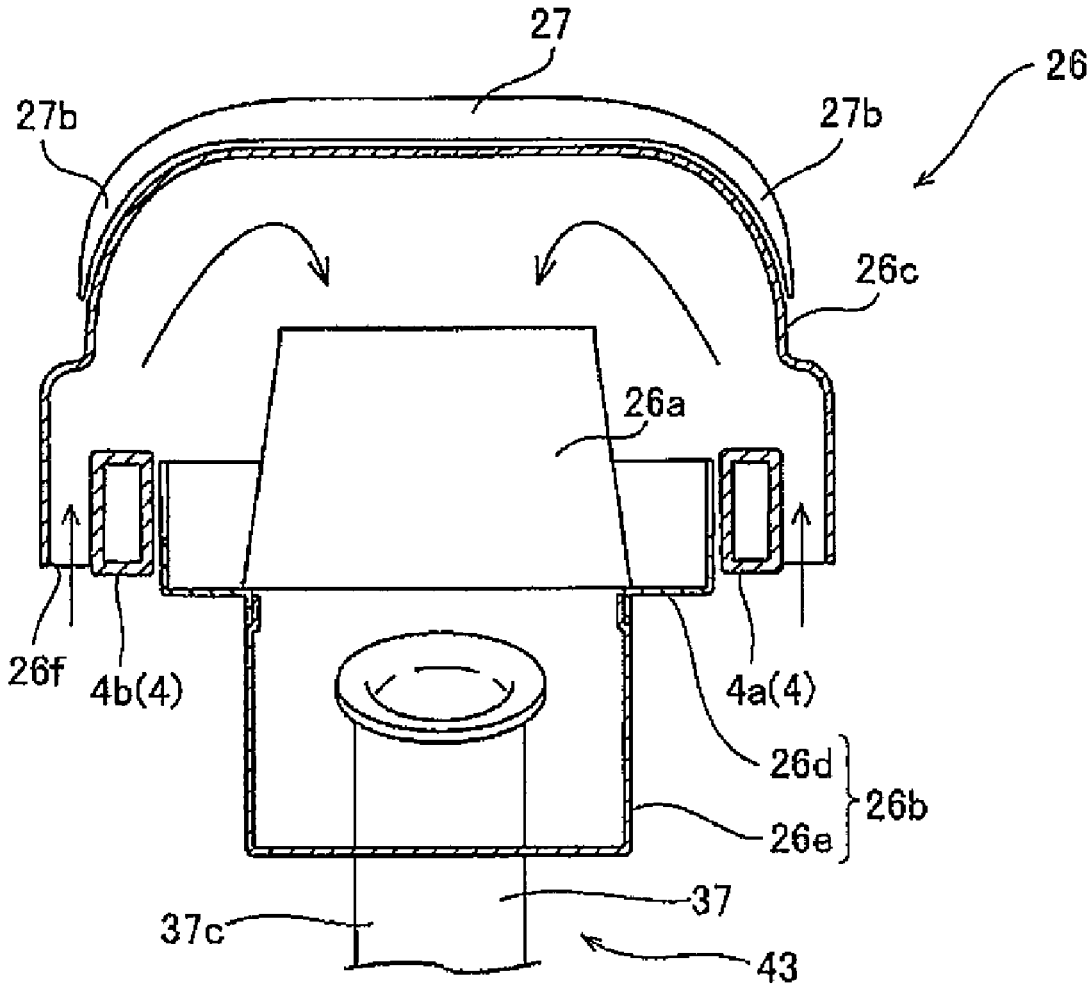
FIG. 5 is a front sectional view of the air cleaner taken along line 100-100 of FIG. 4.

As shown in FIG. 2, an air cleaner 26 is located between left and right tank rails 4*a* and 4*b*. As shown in FIG. 1, air cleaner 26 is located in front of and above engine 29. As shown in FIG. 4, air cleaner 26 includes a sponge filter 26*a*, a cleaner case 26*b* disposed within filter 26*a* and a cover member 26*c* for covering an upper part of cleaner case 26*b*. Cleaner case 26*b* includes an upper case part 26*d* to which filter 26*a* is fixed, and a lower case part 26*e* in which a resin funnel 37 is disposed. An opening 26*f* formed in a diagonally front lower part of cover member 26*c* allows air to flow therein from the front (FIG. 5). Air enters from opening 26*f* and flows through filter 26*a* into lower case part 26*e* of cleaner case 26*b*. Opening 26*f* is located rearward from front number plate 13 to prevent entry of foreign matter (water, pebbles and the like) into opening 26*f*.

Figure 6:
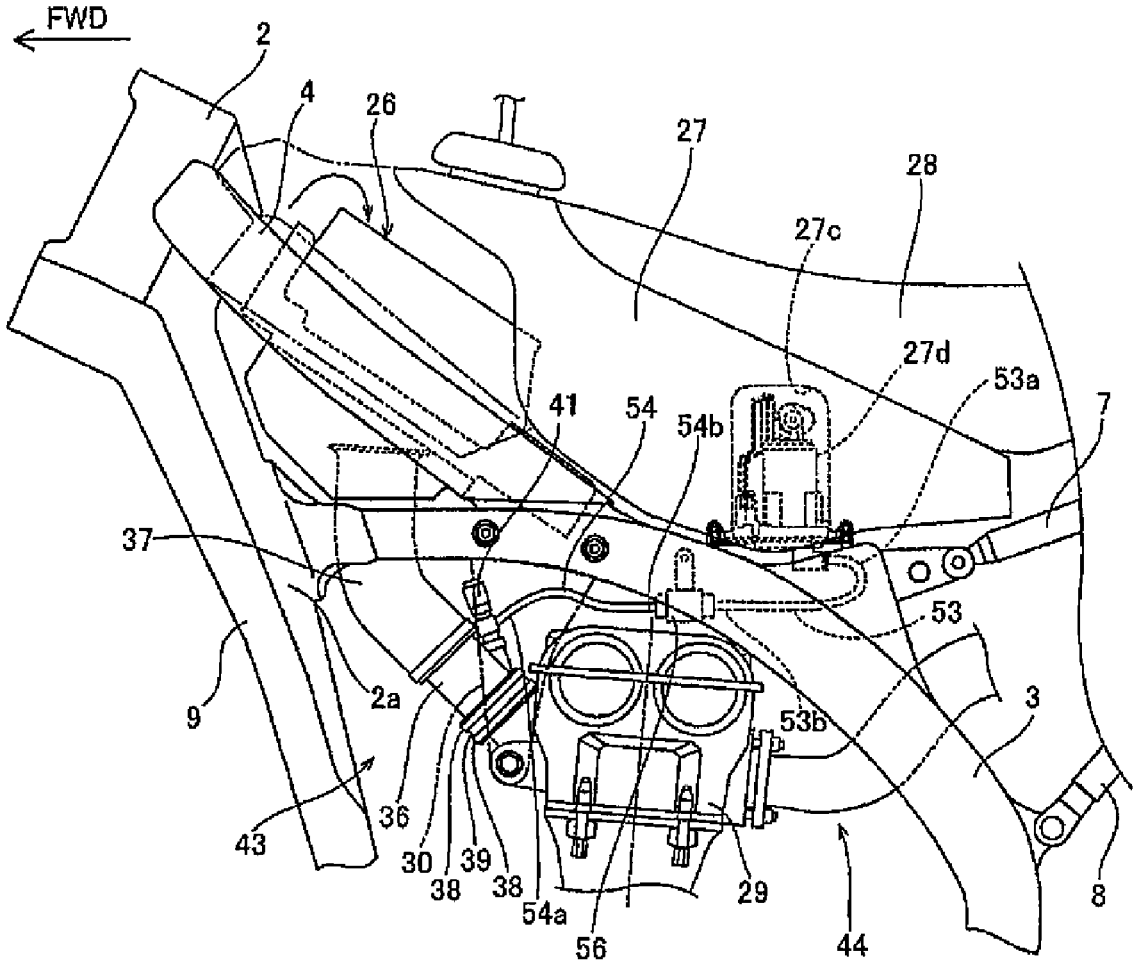
FIG. 6 is another view showing the components of FIG. 4 relative to frame members of the motorcycle of FIG. 1.

A fuel tank 27 made of resin extends rearward from air cleaner 26 (FIG. 4). A center of gravity g1 of fuel tank 27 is close to a center of gravity G of the vehicle, as shown in FIG. 1. In this embodiment, the center of gravity G of the vehicle is to the rear of the center of gravity g1 of fuel tank 27. As shown in FIG. 6, a rear portion of fuel tank 27 is located above main frame 3 and a front portion of fuel tank 27 extends forward and upward along tank rail 4. Fuel tank 27 includes an upper overlying part 27*a* that lies over an upper part of air cleaner 26 and a side overlying part 27*b* that lies over a side part of air cleaner 26.

Figure 7:
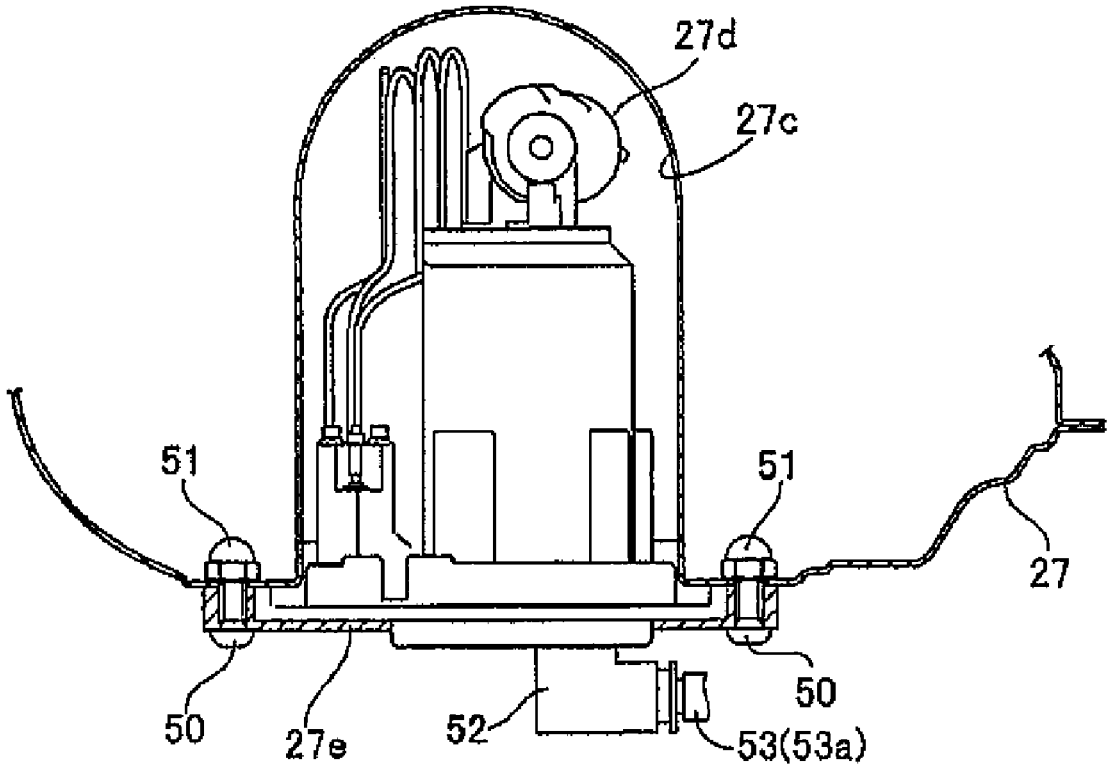
FIG. 7 is a partial sectional view showing a recess formed in a bottom surface of the air cleaner of the motorcycle of FIG. 1.

As shown in FIGS. 6 and 7, a recess 27*c* having a concave shape extends upward from the bottom of fuel tank 27. A fuel pump 27*d* that supplies fuel in tank 27 to a fuel injector 41 is accommodated in recess 27*c*. A plate 27*e* for supporting fuel pump 27*d* is provided at the bottom of fuel pump 27*d*. Fuel pump 27*d* is fixed to fuel tank 27 by screwing screw members 50 through plate 27*e* into respective insert nuts 51 that are formed with fuel tank 27. An elbow 52 attached below plate 27*e* directs fuel drawn by pump 27*d* out of tank 27 into a hose 53 connected to elbow 52 on one side 53*a*. In other words, hose 53 is connected to fuel pump 27*d*. Hose 53 is an example of the "first hose" of the present invention.

A front part of seat 28 is located above a rear part of fuel tank 27. Seat 28 extends to the rear of fuel tank 27.

Engine 29 is located below main frame 3. Engine 29 is fixed by a support plate 30 fastened to main frame 3, a support plate 31 fastened to down tube 9, and a support plate 32 fastened to bottom frame 10. In this embodiment, cylinder axis L1 of engine 29 (FIG. 4) is angled rearward by approximately 5 degrees such that a center of gravity g2 of engine 29 is close to the center of gravity G of the vehicle. In this embodiment, the center of gravity G of the vehicle is to the rear of the center of gravity g2 of engine 29.

Figure 8:
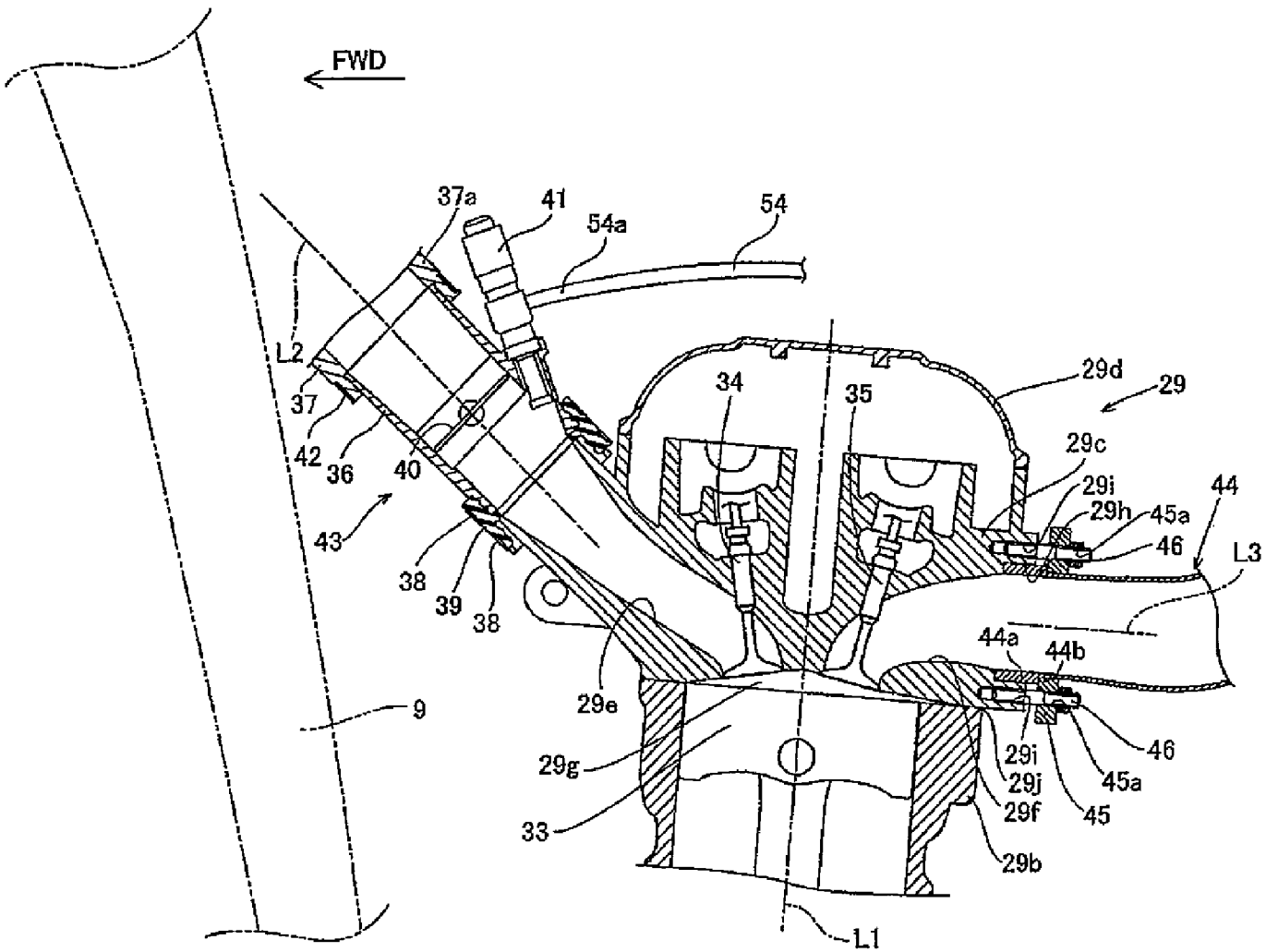
FIG. 8 is a sectional view of the engine and its surroundings of the motorcycle of FIG. 1.

Engine 29 includes a crankcase 29*a*, a cylinder 29*b* having a piston 33 disposed therein, a cylinder head 29*c* disposed above cylinder 29*b* and a cylinder head cover 29*d* (FIGS. 3 and 8). Cylinder head 29*c* has an intake port 29*e* extending forward, an exhaust port 29*f* extending rearward, and a combustion chamber 29*g* to which intake port 29*e* and exhaust port 29*f* are connected. An intake valve 34 opens or closes intake port 29*e*, and an exhaust valve 35 opens or closes exhaust port 29*f*.

A throttle body 36 and funnel 37 are connected to intake port 29*e*. A rubber coupling member 39 is fastened on one end side (downstream side) to intake port 29*e* by a band member 38. Throttle body 36 is fastened to the other end side (upstream side) of coupling member 39 by band member 38 and extends obliquely upward therefrom in straight form. Throttle body 36 is an example of a "connecting part of intake pipe" of the present invention. A throttle valve 40 that adjusts the amount of air to flow through intake port 29*e* is disposed within throttle body 36.

A fuel injector 41 that supplies fuel (gasoline) to engine 29 is attached to throttle body 36. A single fuel injector 41 is mounted on a rearward side of throttle body 36 relative to a forward side where down tube 9 is disposed. Fuel injector 41 is also forward of (in the arrow FWD direction) fuel pump 27*d* (FIG. 6).

Figure 9:
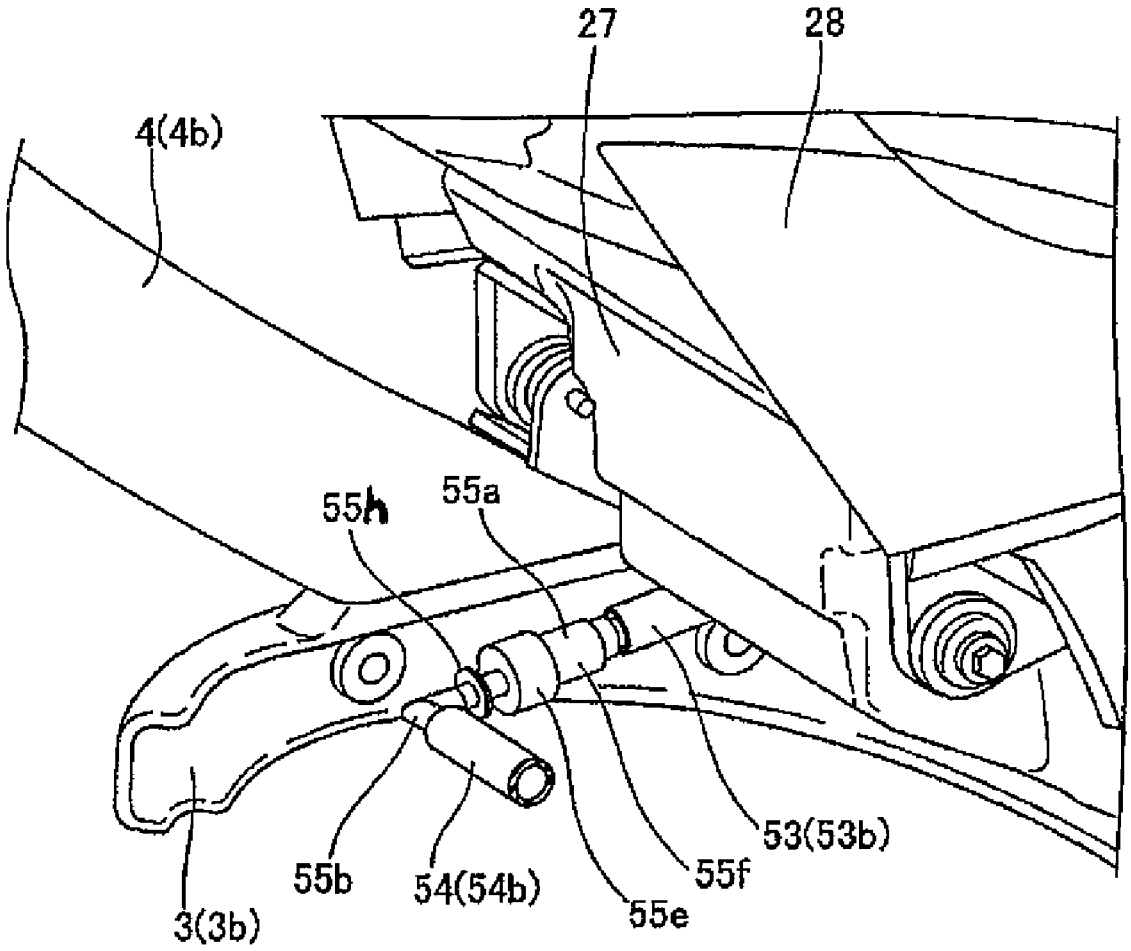
FIG. 9 is a perspective view showing a hose connecting member and its surroundings of the motorcycle of FIG. 1.

A hose 54 is connected to fuel injector 41 on one side 54*a*. Hose 54 is an example of a "second hose" of the present invention. As best seen in FIG. 9, the other side 54*b* of hose 54 is connected to side 53*b* of hose 53, which is connected to fuel pump 27*d*. Hose connecting members 55*a* and 55*b* are attached to and connect, respectively, hoses 53 and 54. Hose connecting members 55*a* and 55*b* are an example of a "first hose connecting part" and "second hose connecting part" of the present invention.

Figure 10:
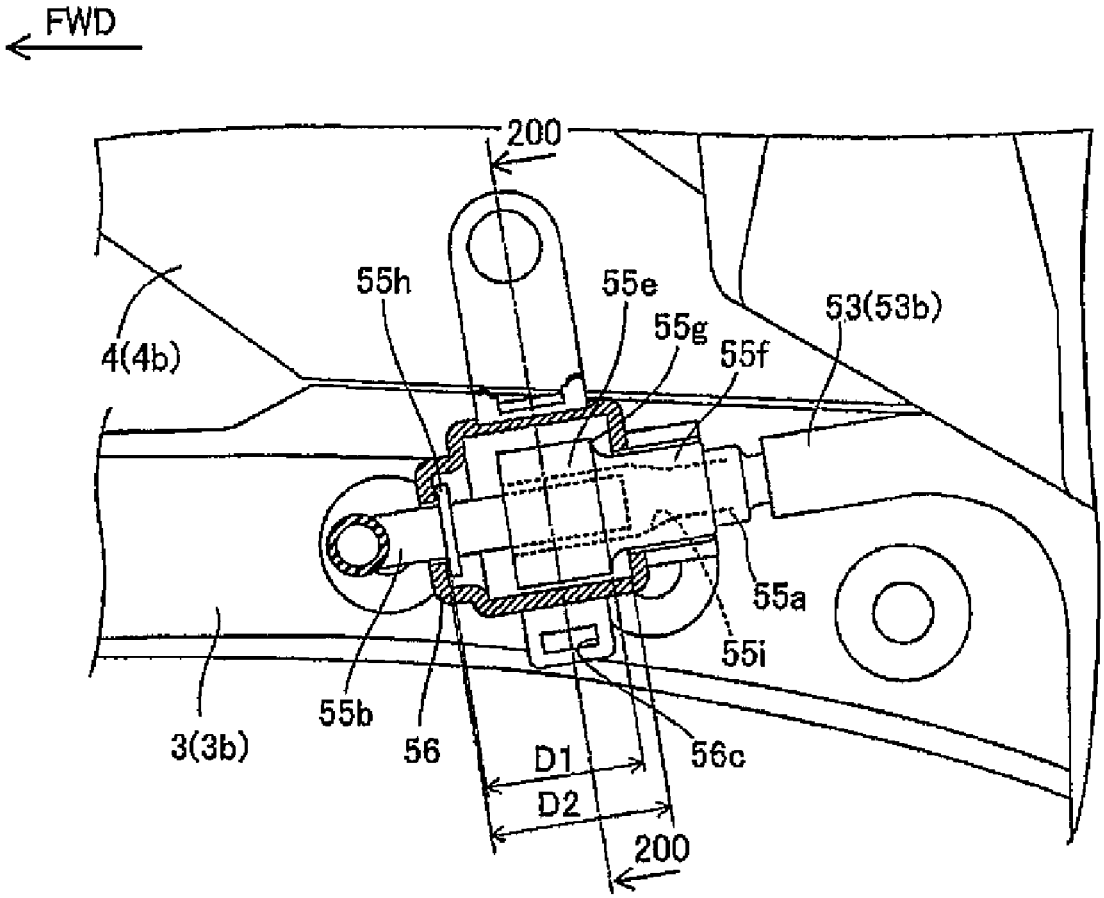
FIG. 10 is a sectional view showing a protective member for the hose connecting member of FIG. 9 and its surroundings.

As shown in FIG. 10, hose connecting members 55*a* and 55*b* engage with each other when connected in a normal state. In other words, hose connecting members 55*a* and 55*b* are rigidly connected and do not easily disengage when connected in a normal state. Hose connecting member 55*a* has two cylindrical parts 55*e* and 55*f* of different diameters. A step 55*g* is formed between cylindrical parts 55*e* and 55*f*. A flange 55*h* protrudes outward from an outer circumferential surface of hose connecting member 55*b*. Hose connecting member 55*a* is inserted onto hose connecting member 55*b* until a distance between step 55*g* and flange 55*h*, which is forward of step 55G, reaches a predetermined distance D1, at which time hose connecting member 55*g* is engaged with hose connecting member 55*b*.

Figure 11:
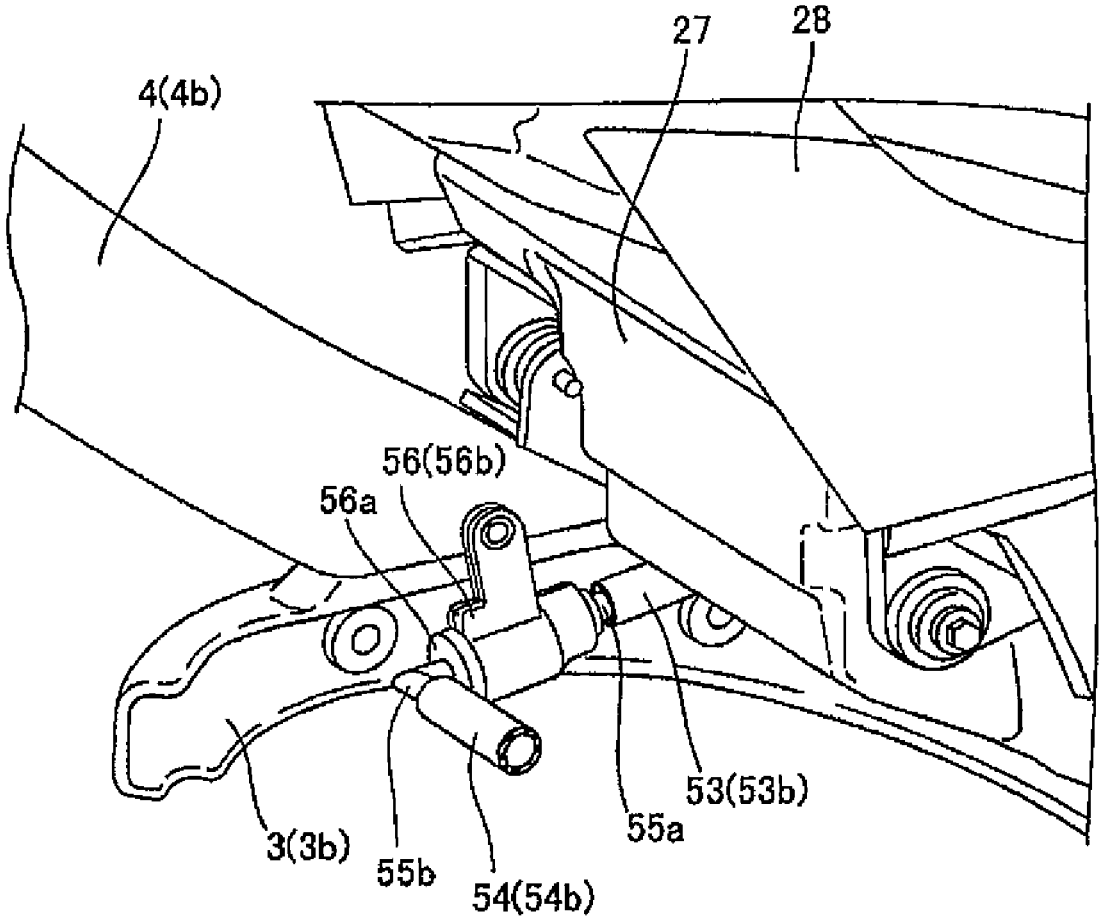
FIG. 11 is a perspective view showing the protective member of FIG. 10 and its surroundings.
Figure 12:
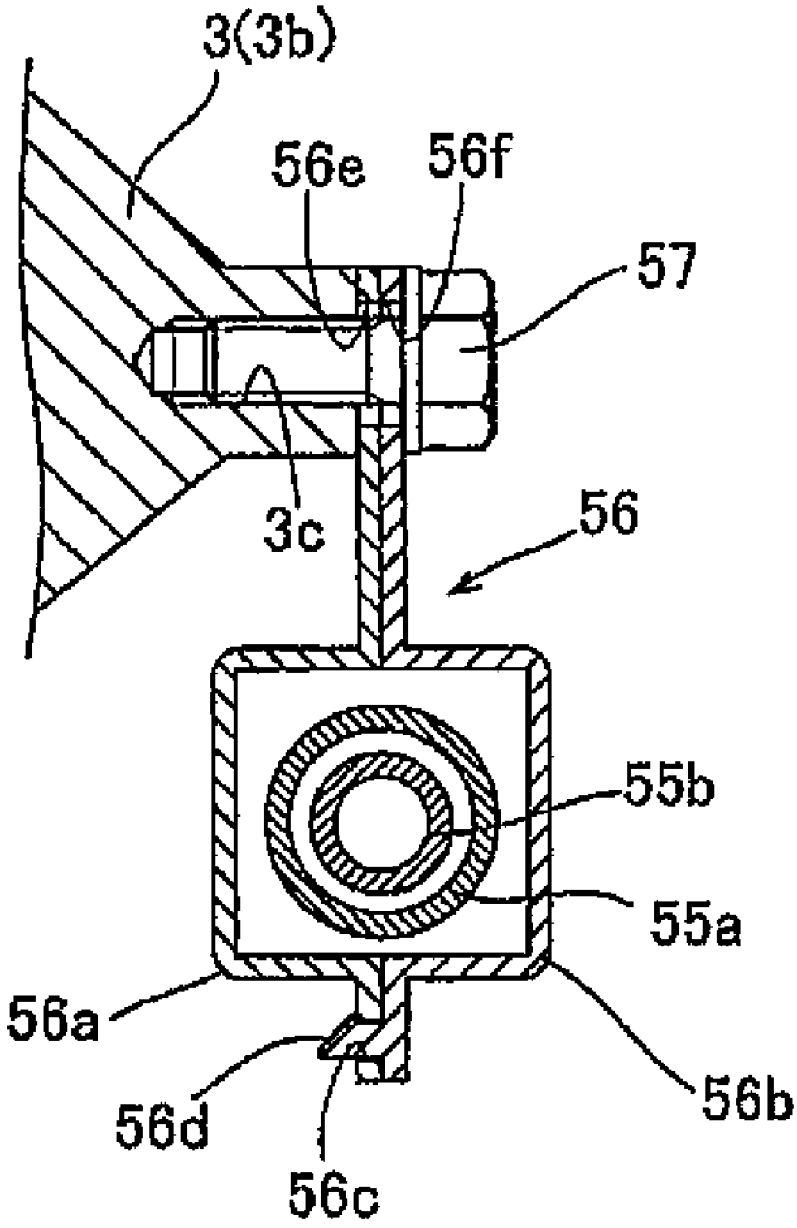
FIG. 12 is a sectional view taken along line 200-200 of FIG. 10.

As shown in FIGS. 10 and 11, a protective member 56 covers the exteriors of members 55*a* and 55*b*. As shown in FIG. 12, protective member 56 includes a one-side protective member 56*a* and an other-side protective member 56*b*. One-side protective member 56*a* and other-side protective member 56*b* are engageable with each other. Specifically, an engaging hole 56*c* of one-side protective member 56*a* is engaged by an engaging claw 56*d* of other-side protective member 56*b*. Protective member 56 is attached to an inner surface in a vehicle width direction of right frame 3*b* by screwing a screw member 57 through screw insertion holes 56*e* and 56*f* of members 56*a* and 56*b* and into screw hole 3*c* of right frame 3*b*.

Protective members 56*a* and 56*b* can be engaged only when hose connecting members 55*a* and 55*b* are connected in a normal state. As shown in FIG. 10, there is a predetermined distance D2 between opposing planes of protective member 56. Distance D2 is slightly longer than distance D1 between step 55*g* and flange 55*h*. Thus, hose connecting members 55*a* and 55*b* can be accommodated within protective member 56 only when connected in a normal state.

Funnel 37 supplies air flowing through air cleaner 26 to engine 29 and is fastened to throttle body 36 on its upstream side by a band member 42. Coupling member 39, throttle body 36 and funnel 37 form intake pipe 43. A lower part of intake pipe 43 is located between engine 29 and down tube 9.

An upstream part of intake port 29*e*, coupling member 39, throttle body 36 and a downstream part 37*a* of funnel 37 are connected along a substantially straight axis L2 extending upward and forward (FIG. 8). Since the part of intake pipe 43 adjacent to engine 29 is in a straight form, air intake resistance is reduced, as compared to a case where the part of intake pipe 43 adjacent to engine 29 is curved or where a part of intake pipe 43 spaced apart from engine 29 is in a straight form. Performance of engine 29 is thereby improved.

In the first embodiment, as shown in FIG. 4, an upstream part 37*c* of funnel 37 is connected to downstream part 37*a* by a curved part 37*b*. Upstream part 37*c* extends upward toward air cleaner 26 in a substantially straight form. An upper part of upstream part 37*c* is located within cleaner case 26*b* of air cleaner 26.

As shown in FIG. 8, an exhaust pipe 44 is connected to exhaust port 29*f* on the rearward side of cylinder head 29*c*. Two screw holes 29*i* and recesses 29*h* are formed adjacent to exhaust port 29*f*. A connecting part 44*a* of exhaust pipe 44 is inserted into recess 29*h*. A step 44*b* is formed at a downstream end of connecting part 44*a* to attach a fixing member 45 to step 44*b*. Stud bolts 46 are screwed into screw holes 45*a* of fixing member 45 and screw holes 29*i* of cylinder head 29*c* to fasten fixing member 45 to cylinder head 29*c*. In this manner, exhaust pipe 44 is fixed to cylinder head 29*c*.

A part of exhaust pipe 44 adjacent to cylinder head 29*c* extends in substantially straight form along an axis L3, which reduces resistance of air exhausted from engine 29, as compared to a case where the part of exhaust pipe 44 adjacent to engine 29 is curved or where a part of exhaust pipe 44 spaced apart from engine 29 is straight. Performance of engine 29 is thereby improved.

As shown in FIG. 3, a portion 44*c* of exhaust pipe 44 connected to the straight-form part adjacent to engine 29 extends upward to the rear. A coil-form part 44*d* connected to portion 44*c* extends upward to the rear and a rear part 44*e* extends upward to the rear. When viewed from above, coil-form part 44*d* is located between left and right seat rails 7*a* and 7*b* (FIG. 2). In addition, as shown in FIG. 3, coil-form part 44*d* is located in a region between rear suspension 23 and tire house A of rear wheel 21. A connecting part 44*f* of exhaust pipe 44 is connected to muffler 47 located above and behind engine 29. Muffler 47 is supported by right seat rail 7*b* (see FIG. 2) through a support plate 48. Muffler 47 is an example of a "silencer" of the present invention.

An axis of connection L4 between exhaust pipe 44 and muffler 47 (FIG. 3) is higher than the axis of connection L3 between exhaust pipe 44 and engine 29. Both axes of connection L3 and L4 are higher than rear end 29*j* (top surface) of cylinder 29*b*. All parts of exhaust pipe 44 are higher than axle 20, rear arm 19 and crankcase 29*a* of engine 29.

As described, in the first embodiment of the invention, cylinder axis L1 of engine 29 is angled rearward such that the center of gravity g2 of engine 29 is located on a rearward side and therefore is close to the center of gravity G of the vehicle. Therefore, the moment of inertia about the center of gravity G of the vehicle is reduced, and maneuverability of the vehicle is improved. In addition, intake pipe 43 is provided on the forward side of engine 29 oriented with its cylinder axis L1 angled rearward, which creates a space around intake pipe 43. This allows coupling member 39, throttle body 36 and downstream part 37*a* of funnel 37, which are in a straight form, to be connected to engine 29. Fuel injector 41 is mounted on a rearward side of throttle body 36 relative to a forward side where down tube 9 is disposed, thereby preventing interference between fuel injector 41 and down tube 9. This eliminates the need for intake pipe 43 (throttle body 36) to have a curved part designed to prevent interference between fuel injector 41 and down tube 9. Therefore, a part of intake pipe 43 connected to engine 29 or throttle body 36 can be in a straight form.

In the first embodiment of the invention, air cleaner 26 is located in front of and above engine 29, while intake pipe 43 has curved part 37*b* upstream of the part of intake pipe 43 connected to engine 29 and upstream part 37*c* located upstream of curved part 37*b* and extending toward air cleaner 26. This allows air cleaner 26 to be disposed apart from engine 29 at a location forward and upward of engine 29, resulting in a decrease in temperature of air flowing through air cleaner 26 and intake pipe 43. Thereby, the density of air drawn into engine 29 increases, and the intake efficiency of engine 29 improves. In addition, air cleaner 26 is located apart from rear wheel 21, which prevents mud and so forth splashed by rear wheel 21 from entering air cleaner 26 and contaminating filter 26*a*. Thus, the size of filter 26*a* (air cleaner 26) can be reduced.

In the first embodiment of the invention, fuel tank 27 lies over the upper part of and extends rearward from air cleaner 26. The center of gravity g1 of fuel tank 27 is thus located on a rearward side and is close to the center of gravity G of the vehicle. The moment of inertia about the center of gravity G of the vehicle is thereby further reduced and maneuverability of the vehicle further improved. In addition, upper and side overlying parts 27*a* and 27*b* of fuel tank 27 lie over the upper and side parts of air cleaner 26, which increases the capacity of fuel tank 27.

In the first embodiment of the invention, exhaust pipe 44 is connected to exhaust port 29*f* on the rearward side of engine 29, and muffler 47 is connected to exhaust pipe 44 above and behind engine 29. The axis of connection L4 between exhaust pipe 44 and muffler 47 is higher than the axis of connection L3 between exhaust pipe 44 and engine 29. Exhaust pipe 44 is thus connected to muffler 47 without passing below engine 29. Therefore, exhaust pipe 44 does not contact the ground, for example, during off-road and mountain travel, thereby preventing damage to exhaust pipe 44.

In the first embodiment of the invention, a front part of seat 28 is located above the rear part of fuel tank 27. This allows fuel tank 27 to extend rearward, so that the center of gravity g1 of fuel tank 27 is moved rearward, and the capacity of fuel tank 27 increases.

In the first embodiment of the invention, fuel pump 27*d* is accommodated in recess 27*c* of fuel tank 27. Fuel tank 27 thereby protects fuel pump 27*d* from physical shock and the like.

In the first embodiment of the invention, fuel injector 41 is forward of fuel pump 27*d*. It is thus easier to ensure space for placing fuel injector 41, compared to a case where fuel injector 41 is behind fuel pump 27*d*, where many parts are laid out. This facilitates placement of fuel injector 41.

In the first embodiment of the invention, hose 53 is connected to fuel pump 27*d* and hose 54 is connected to fuel injector 41. Hoses 53 and 54 are connected in an area where relatively fewer peripheral parts are laid out, after placing fuel pump 27*d* at a predetermined location. Thereby, the work of connecting fuel injector 41 and fuel pump 27*d* is made easier, as compared to a case where fuel pump 27*d* and fuel injector 41 are assembled at predetermined locations, and then connected directly by one hose around which many peripheral parts are laid out.

In the first embodiment of the invention, hose connecting members 55*a* and 55*b* connect hose 53 and hose 54. Protective member 56 attached to main frame 3 covers connecting members 55*a* and 55*b*. Sand, dust and the like is thus prevented from entering hose connecting members 55*a* and 55*b*.

In the first embodiment of the invention, hose connecting members 55*a* and 55*b* must be connected in a normal state in order for one-side protective member 56*a* and other-side protective member 56*b* of protective member 56 to be engaged. This allows one to confirm whether hose connecting members 55*a* and 55*b* are connected normally when protective member 56 is assembled.

Second Embodiment

Figure 13:
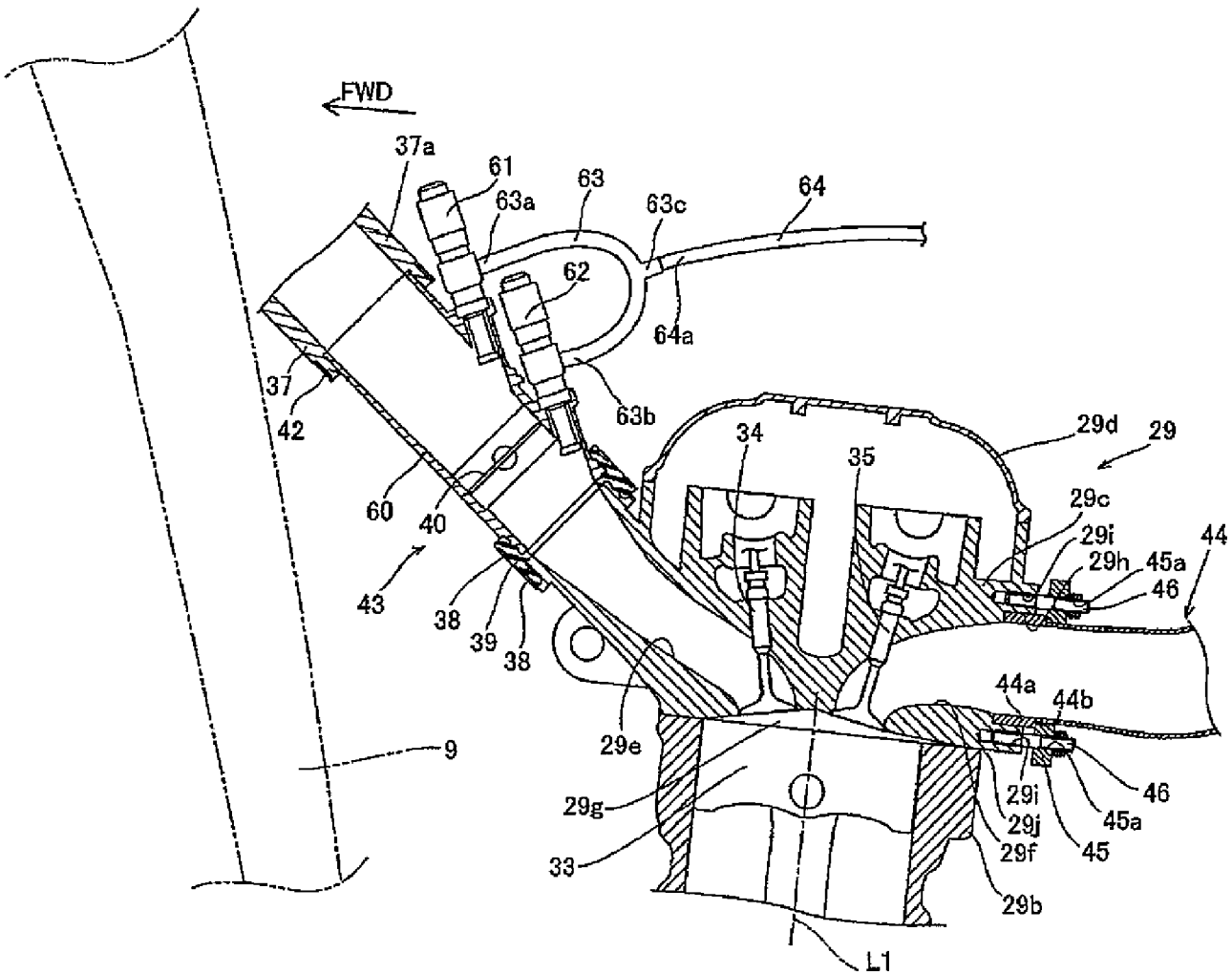
FIG. 13 is a sectional view of an engine and its surroundings of a motorcycle according to a second embodiment of the present invention.

FIG. 13 illustrates a motorcycle according to a second embodiment of the present invention. In the second embodiment, an example is described where two fuel injectors are provided.

As shown in FIG. 13, a throttle body 60 extending obliquely upward in a straight form is fastened to coupling member 39 on an upstream side by band member 38. Throttle body 60 is an example of the "connecting part of intake pipe" of the present invention. Throttle valve 40 adjusts the amount of air to flow through intake port 29*e* and is disposed within throttle body 60. Fuel injectors 61 and 62 supply fuel (gasoline) to engine 29 and are attached to throttle body 60.

In the second embodiment of the invention, fuel injectors 61 and 62 are both mounted on a rearward side of throttle body 60 relative to a forward side where down tube 9 is disposed. Fuel injector 61 is mounted upstream of throttle valve 40 in throttle body 60, while fuel injector 62 is mounted downstream of throttle valve 40. Fuel injectors 61 and 62 are examples of a "first fuel injector" and a "second fuel injector" of the present invention.

In the second embodiment of the invention, branch parts 63*a* and 63*b* of a metallic branch piping 63 are connected to fuel injectors 61 and 62. An inflow part 63*c* of branch piping 63 is connected to one side 64*a* of a hose 64. Hose 64 is an example of a "second hose" of the present invention.

The other parts of the motorcycle of the second embodiment of the invention are the same as in the first embodiment, and description thereof is not repeated.

As described in the second embodiment of the invention, fuel injector 61 is mounted upstream of throttle valve 40 in throttle body 60, while fuel injector 62 is mounted downstream of throttle valve 40. This allows fuel injectors 61 and 62 to spray a larger amount of fuel to air flowing through throttle body 60 toward engine 29, compared to a case where a single fuel injector is provided. Combustibility of the air-fuel mixture in engine 29 is thereby improved and output from engine 29 is increased.

The other effects of the second embodiment are the same as those of the first embodiment.

It should be understood that the embodiments disclosed herein are illustrative in all respects, and do not impose any limitation. The scope of the invention is defined by the claims rather than by the described embodiments, and includes all modifications falling within the scope of the claims and equivalents thereof.

The present invention has been described as applied to a motorcycle. However, the invention is not limited to that and may be applicable to other vehicles such as, for example, an automobile, a bicycle, a tricycle, and an all terrain vehicle (ATV). The invention is also not limited to an off-road motorcycle and may be applicable to an on-road motorcycle.

The engine has been described as oriented with its cylinder axis angled rearward by approximately 5 degrees. However, the invention is not so limited and the engine may be oriented with its cylinder axis angled rearward by more than 5 degrees.

The intake pipe has been described as having a curved part between a straight connecting part and a straight upstream part. However, the invention is not so limited, and the intake pipe may be entirely straight and not have any curved part.

The part of the exhaust pipe adjacent to the engine has been described as substantially in a straight form. However, the invention is not so limited, and the part of the exhaust pipe adjacent to the engine may not necessarily be straight.

The invention claimed is:

1. A vehicle comprising:

a head pipe;

an engine disposed with a cylinder axis thereof inclined rearward;

a body frame located in front of the engine and extending downward from the head pipe;

a main frame connected to a rear part of the head pipe and passing over the engine in a longitudinal direction;

a fuel tank located above the main frame, wherein a portion of a bottom wall of the fuel tank defines a recess formed into a concave shape and extending upward from a bottom of the fuel tank;

an intake pipe located between the body frame and the engine and extending obliquely upward from a forward side of the engine;

a fuel injector mounted to the intake pipe, wherein the intake pipe has a straight connecting part that is connected to the engine, and the fuel injector is mounted on a rearward side of the intake pipe relative to a forward side where the body frame is disposed;

a fuel pump for supplying fuel from the fuel tank to the fuel injector, wherein the fuel pump is positioned outside of the fuel tank and within the recess defined by the portion of the bottom wall of the fuel tank; and an air cleaner located in front of and above the engine, wherein the intake pipe includes a curved part located upstream of the connecting part of the intake pipe and an upstream part located upstream of the curved part and extending toward the air cleaner.

2. The vehicle according to claim 1, further comprising a fuel tank that extends rearward from the air cleaner and includes an upper overlying part that lies over an upper part of the air cleaner.

3. The vehicle according to claim 2, wherein the fuel tank includes a side overlying part that lies over a side part of the air cleaner.

4. The vehicle according to claim 2, further comprising a seat located above a rear part of the fuel tank.

5. The vehicle according to claim 1, further comprising:

an exhaust pipe connected to a rearward side of the engine; and a silencer connected to the exhaust pipe above and behind the engine, wherein a part of the exhaust pipe connected to the silencer is higher than a part of the exhaust pipe connected to the engine.

6. The vehicle according to claim 5, wherein an axis of connection between the exhaust pipe and the silencer is higher than an axis of connection between the exhaust pipe and the engine.

7. The vehicle according to claim 5, wherein the exhaust pipe comprises:

a straight connecting part connected to the engine; and a portion coupled with the connecting part and extending upward to the rear.

8. The vehicle according to claim 1, further comprising:

a rear wheel; and an axle to which the rear wheel is rotatably mounted, wherein the exhaust pipe is higher than the axle.

9. The vehicle according to claim 1, further comprising:

a rear wheel; and a rear arm for supporting the rear wheel, wherein the exhaust pipe is higher than the rear arm.

10. The vehicle according to claim 1, wherein the engine comprises:

a crankcase;

wherein the exhaust pipe is higher than the crankcase.

11. The vehicle according to claim 1, further comprising:

a throttle valve provided within the connecting part to adjust an amount of air flowing through an interior of the intake pipe, wherein the fuel injector includes a first fuel injector mounted upstream of the throttle valve in the connecting part and a second fuel injector mounted downstream of the throttle valve in the connecting part.

12. The vehicle according to claim 1, wherein the fuel injector is forward of the fuel pump.

13. The vehicle according to claim 1, further comprising:

a first hose connected to the fuel pump; and a second hose connected to the fuel injector.

14. The vehicle according to claim 13, further comprising:

a hose connecting part connecting the first and second hoses; and a protective member mounted to the main frame to cover the hose connecting part.

15. The vehicle according to claim 14, wherein:

the hose connecting part includes a first hose connecting part connectable to a second hose connecting part, the protective member includes a one-side protective member engageable with an other-side protective member, and the one-side protective member can be engaged with the other-side protective member only when the first and second hose connecting parts are connected in a normal state.

16. The vehicle according to claim 1, wherein the vehicle is an off-road motorcycle.

17. A vehicle comprising:

an engine;

a fuel tank, wherein a portion of a bottom wall of the fuel tank defines a recess formed into a concave shape and extending upward from a bottom of the fuel tank; and a fuel pump for supplying fuel from the fuel tank to the engine, wherein the fuel pump is positioned outside of the fuel tank and within the recess defined by the portion of the bottom wall of the fuel tank.

18. The vehicle according to claim 17, and further comprising:

a head pipe;

a body frame located in front of the engine and extending downward from the head pipe;

a main frame connected to a rear part of the head pipe and passing over the engine in a longitudinal direction, wherein the fuel tank is located above the main frame;

an intake pipe located between the body frame and the engine and extending obliquely upward from a forward side of the engine; and a fuel injector mounted to the intake pipe, wherein the intake pipe has a straight connecting part that is connected to the engine, the fuel injector is mounted on a rearward side of the intake pipe relative to a forward side where the body frame is disposed, and the fuel pump supplies fuel from the fuel tank to the fuel injector.

* * * * *